US009222751B2

(12) United States Patent
Glock

(10) Patent No.: US 9,222,751 B2
(45) Date of Patent: Dec. 29, 2015

(54) HOLSTER

(75) Inventor: Gaston Glock, Velden (AT)

(73) Assignee: Value Privatstiftung (AU)

( * ) Notice: Subject to any disclaimer, the term of this patent is extended or adjusted under 35 U.S.C. 154(b) by 841 days.

(21) Appl. No.: 12/733,493

(22) PCT Filed: Sep. 8, 2008

(86) PCT No.: PCT/AT2008/000319

§ 371 (c)(1),
(2), (4) Date: Jul. 1, 2010

(87) PCT Pub. No.: WO2009/029972

PCT Pub. Date: Mar. 12, 2009

(65) Prior Publication Data

US 2010/0320242 A1 Dec. 23, 2010

(30) Foreign Application Priority Data

Sep. 7, 2007 (AT) ..... A 1407/2007

(51) Int. Cl.
*F41C 33/04* (2006.01)
*F41C 33/02* (2006.01)

(52) U.S. Cl.
CPC ..... *F41C 33/045* (2013.01); *F41C 33/0236* (2013.01); *A45F 2200/0591* (2013.01)

(58) Field of Classification Search
CPC ..... F41C 33/045; A45F 2200/0591; A45F 2005/025–2005/026
USPC ..... 224/272, 661, 663, 665–666, 912, 683
See application file for complete search history.

(56) References Cited

U.S. PATENT DOCUMENTS

| | | | | | |
|---|---|---|---|---|---|
| 2,819,830 | A * | 1/1958 | Murray | 224/578 |
| 4,022,361 | A * | 5/1977 | Devlin | 224/192 |
| 4,828,154 | A * | 5/1989 | Clifton, Jr. | 224/661 |
| 4,883,290 | A * | 11/1989 | Landa | 280/814 |
| 5,501,379 | A * | 3/1996 | Munoz | 224/240 |
| 5,533,656 | A * | 7/1996 | Bonaldi | 224/667 |
| 5,833,095 | A * | 11/1998 | Russell et al. | 224/576 |
| 5,850,996 | A * | 12/1998 | Liang | 248/221.11 |
| 5,988,315 | A * | 11/1999 | Crane | 182/3 |
| 6,161,741 | A * | 12/2000 | French | 224/198 |
| 6,216,931 | B1 * | 4/2001 | Trawinski | 224/583 |
| 6,478,202 | B1 * | 11/2002 | Glock | 224/198 |
| 7,819,370 | B2 * | 10/2010 | Ho | 248/304 |
| 2002/0170933 | A1 * | 11/2002 | Martin | 224/197 |
| 2008/0061098 | A1 * | 3/2008 | Hoffner | 224/661 |

* cited by examiner

*Primary Examiner* — J. Gregory Pickett
*Assistant Examiner* — John Cogill
(74) *Attorney, Agent, or Firm* — Kolisch Hartwell, P.C.

(57) ABSTRACT

The invention concerns a holster which has a weapon part (10) for a weapon which is detachably connected to a fastening part (1), whereby the fastening part (1) has at least one connection device (21, 21') and the weapon part (10) having a connection counter device (23) that acts in combination with it.

Figure 2:
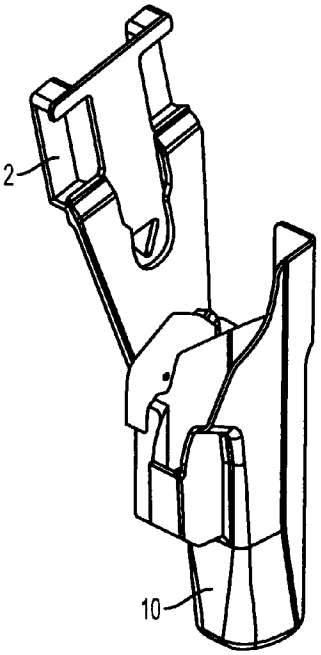

The invention is characterized by an adapter (12) being detachably providable between the weapon part (10) and the fastening part (1), said adapter (12) having in the area of one of its ends a connection counter device (24) which corresponds geometrically to the connection counter device (23) of the weapon part (10) and having in the area of its other end a connection device (22) which corresponds geometrically to the connection device (21, 21') of the fastening part (1).

7 Claims, 4 Drawing Sheets

HOLSTER

The invention concerns a holster which has a weapon part for a weapon which is detachably connected to a fastening part, whereby the fastening part has at least one connection device and the weapon part has a connection counter device that acts in combination with it, corresponding to the pre-characterizing clause of claim 1. The fastening part can be either a belt part or a so-called "pad" that can be pushed into a slot or a fold of a tightly fitting piece of clothing of the wearer. "Detachably" is to be understood in the description and the claims in particular as such connection devices that can be both detached and connected without the use of tools.

A holster of that sort, with which the fastening part is a belt part, is known from U.S. Pat. No. 6,478,202 B of the applicant, corresponding to AT 410 976 B. The content of the first cited document is made into the content of this present application through citation. The holster according to that document has not only the special feature that the weapon part is stored in a rotating manner with respect to the carrier part and can be locked into one or two angle positions if necessary, but also that two fastening points are provided on the carrier part for the weapon part such that depending upon the desire of the wearer, the weapon can be carried higher or lower.

From U.S. Pat. No. 6,755,331 B and even more so from the publication of the application US 2003/0205594 A, the content of these two documents are brought into this present application through citation, [and] different formulations of holsters are known, including shoulder holsters, leg holsters that are to be carried low down with a hinge for adaptation to leg movement, holsters that are worn above the belt without a shoulder harness, and more of those that are similar. The goal of the document is to create all of these holsters out of as few parts as possible that are to be combined with each other as freely as possible in the manner of a kit in order to make it possible for the wearer to select from the most varied of configurations with different clothing and on different occasions while, however, always using one and the same specially formulated weapon part that is precisely coordinated with the weapon.

Two components are viewed as a central integral part of the kit: a multifunctional assembly plate, which can be connected in various ways as needed with different fastening parts, extensions, rotating parts, and preferably the same weapon part, in order to create the various desired configurations right away each time. The second central integral part is the weapon part, which surrounds and holds as a U-shape the uppermost area of the slot as well as, though, the entire length of the weapon.

The connection of the individual components takes place by means of screws, nuts, shims, and retaining rings. For the conversion of the holster, it is therefore necessary to loosen and keep available these elements by means of a pair of pliers or a wrench (together with a lock nut), to carry out the corresponding changes, and to once again screw together the altered holster, an activity which cannot be carried out very well outside of the armory and takes quite some time.

A holster with which the carrying part consists of a pad is known from U.S. Pat. No. 6,752,300 B, and the content of this document is also brought into this present application through citation. With this holster, though, no separation is provided between the weapon part and the pad, but holsters of that sort, which can be disassembled, are also known in practice.

With both types of holsters—actually, with both types of fastening parts—the weapon is held relatively high in the hip area of the wearer. There is then occasionally the desire to carry the weapon lower down, on the thigh, which is not possible with the holsters that have thus far been cited and described. This is possible with U.S. Pat. No. 6,755,331 B, for which an extension part that can swivel is attached to the assembly plate, said plate for its part accepting the weapon part; this of course takes place by means of the cited tool.

From U.S. Pat. No. 5,372,288 A, the content of which is hereby made the content of this present application through citation, a holster is known with which the weapon part can be pushed onto the carrier part along a rod and attached at different heights. Within that context, the rod is in the area of the carrying part which is located at belt height and is fastened in a swiveling and attachable manner. Even if the user releases the rotating motion such that the rod can follow the motion of the thigh when the wearer is walking, the construction still has the disadvantage that the orientation of the weapon with respect to the orientation of the rod is always the same, and that the weapon part can indeed be moved along the rod and under circumstances is also detachable from it, but it cannot be used with any other holding part. The holster according to WO2006/076753 A is built in a similar manner and also has the same advantages and disadvantages as the holster according to the US A patent.

Finally, U.S. Pat. No. 4,690,315 A is also known, the content of which is hereby made the content of this present application through citation, which in actuality does not concern any holster, but rather a special belt rod that can be opened in such a way that it can be moved over the belt and then closed again, whereby it is not necessary to thread the belt through it. What is interesting for this present invention is not so much this core of the application as its FIGS. 18 and 19 in which a textile strip is portrayed which hangs on the belt of a user and at the lower end of which—consequently, in the area of the thigh—a holster is fastened with the help of such a rod. This holster can also be directly fastened to the belt, since the bands that are placed around the thigh which prevent the loose dangling of the holster with respect to the thigh are indeed fastened to the holster but are detachable from it.

From DE 93 13 311 U, for which there is no English-language counterpart, a so-called "swinging bridge holster" is known which has the following construction: the holster is one part in and of itself (and consequently not generically) and has two mounting elements in the end area away from the weapon: firstly, a customary belt loop and secondly, a slot-shaped recess with a semicircular end area. During so-called "summer operation", the belt of the wearer is pulled through the belt loop and the holster is worn "short". In winter operation, an extension is used which has a belt loop on one end and a pin at the other end which works together with the slot-shaped recess and connects the two parts with each other in a rotating manner. This holster is actually extendable without a tool, but it has a series of other disadvantages: during winter operation, the belt loop of the holster gets in the way of the user, which is disturbing in particular in case of emergency; because of the pin, the extension has a distinct cross reach, which makes its accommodation difficult; re-equipping requires the threading out and threading in of the belt; and through the doubling of the mounting elements, the mechanical sturdiness of the holster is impaired.

Added to all of this is also the fact that in recent years, the holster or its weapon parts have been increasingly equipped with safety devices against the undesired pulling of the weapon out of the holster, a safety measure which is described, for example, by U.S. Pat. No. 6,752,300 B or U.S. Pat. No. 6,371,341 B, or in particular by U.S. Pat. No. 5,275,317 A or U.S. Pat. No. 6,276,581 B, the content of which is made into the content of this present application through citation. The users of holsters of that type know their use and their properties very precisely and have the firm desire to always use the same holster or weapon part of the holster to which they are accustomed.

In many cases, it is necessary for deployment tactical reasons or reasons related to equipment (such as body protection equipment) to carry the weapon on the leg. If such a case occurs, then the change from the higher position to the leg position and vice-versa is to take place quickly and without a great expenditure.

The idea offered in the aforementioned U.S. Pat. No. 6,478,202 B to arrange a plurality of connection points on a fastening part for the weapon part proves to be worthwhile, for example, in order to be used both with winter clothing and with a summer uniform, but it fails with the problem that forms the basis of the invention because of the length of the part that is necessary for this, and therefore it cannot be used for a leg holster.

The other proposals and ideas in the state of the art require, if they are at all possible, a costly and awkward re-equipping of the entire multipart holster, which is not possible without a tool and has not proven to be worthwhile in practice for understandable reasons.

The problem of the invention is consequently to create a holster of the type mentioned in the beginning that can easily and simply be re-equipped.

These goals are inventively achieved by means of the characterizing features of claim 1. In this way, it is possible by means of the simple removal of the weapon part from the fastening part and the mounting of the adapter to achieve the necessary and desired position of the weapon part in the leg area.

If the connection between the weapon part and the fastening part allows an angular attachment between the two parts, then the connecting part of the adapter is preferably adapted to the fastening part in such a way that no fastening takes place of the angular position. This can usually be achieved simply by means of leaving out the projections that are responsible for this.

The adapter preferably has a band that can be adjusted in length and/or is elastic and flexible in the end area in which the weapon part is fastened with which this area can be fastened to the thigh of the wearer in order to avoid any free swinging or dangling of the holster.

Figure 3:
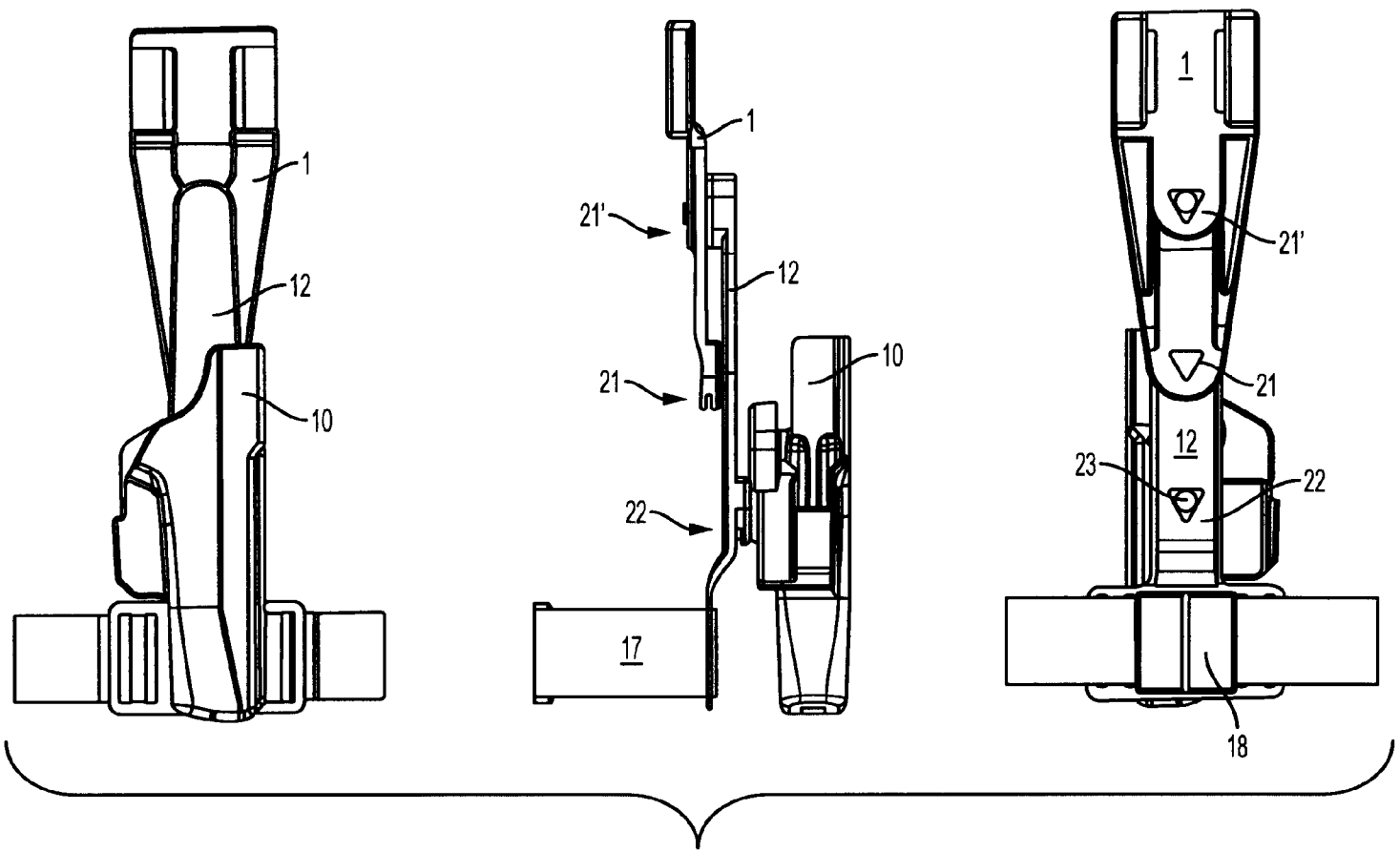
Figure 4:
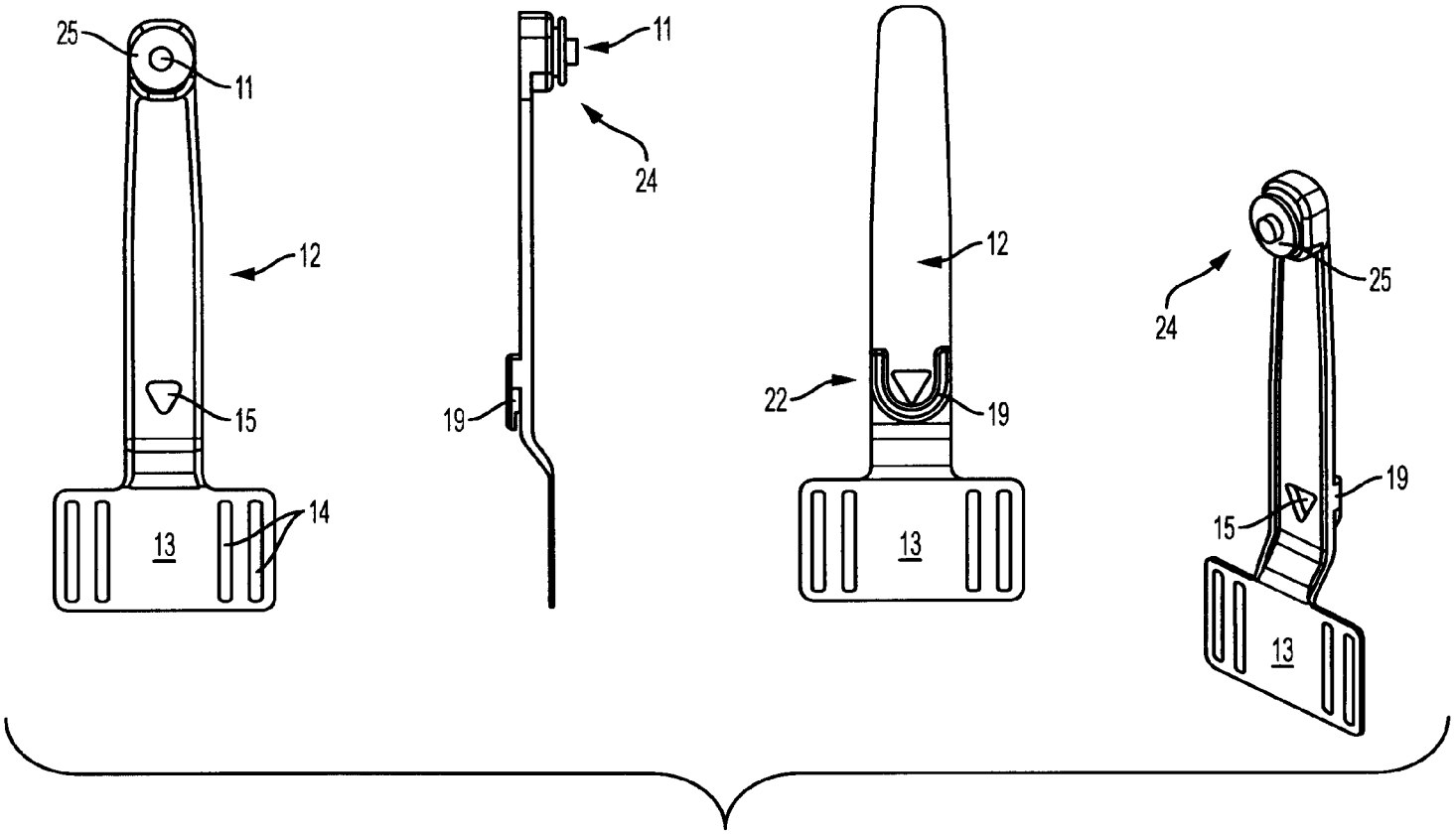
Figure 7:
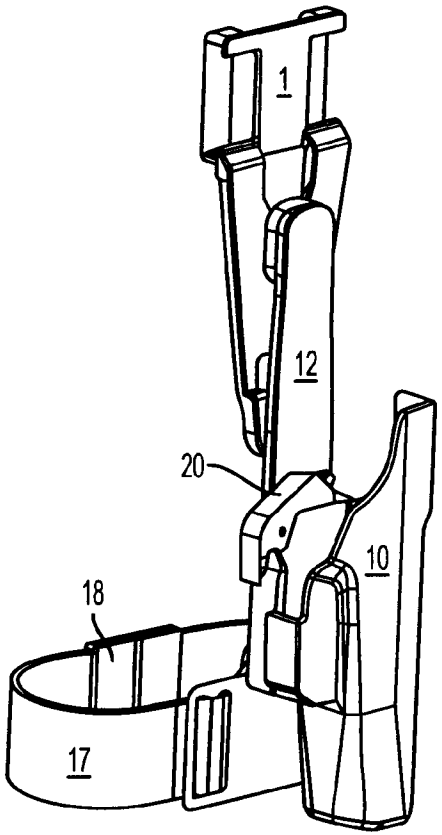
Figure 5:
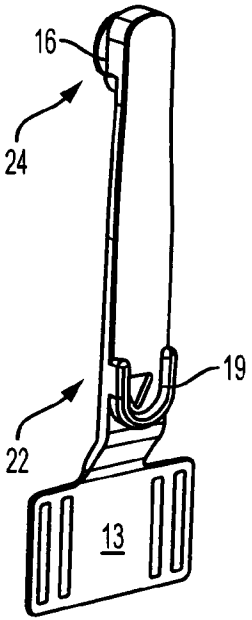

The invention shall be explained in greater detail below through the use of the drawing. Within that regard, FIG. 1 depicts the fastening part of the holster according to the state of the art, FIG. 2 depicts the fastening part of FIG. 1 with a weapon part, FIG. 3 depicts an inventive extension part that is mounted between the known holster parts in three views, FIG. 4 depicts an inventive adapter in four views, FIG. 5 depicts an inventive adapter in a perspective view, FIG. 6 depicts a view according to the state of the art, similar to FIG. 2, and FIG. 7 depicts a perspective view of the assembly from FIG. 3.

Figure 1:
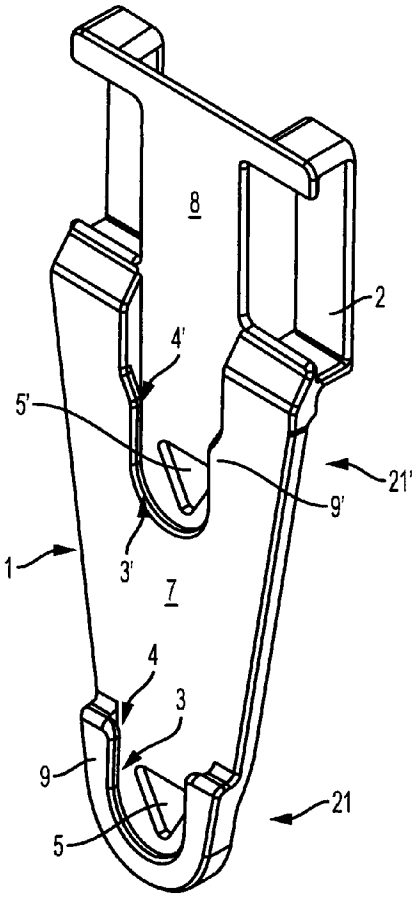
Figure 6:
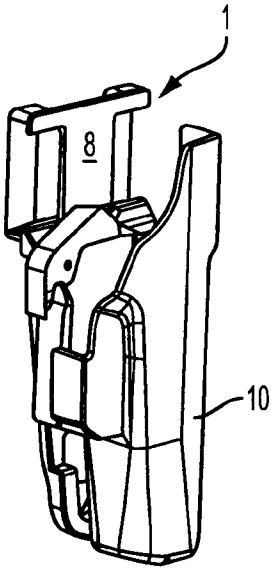

FIGS. 1, 2, and 6 depict a holster as it is known from U.S. Pat. No. 6,478,202 B. This previously known holster consists of a fastening part 1, namely a belt part, and a weapon part 10, which can be detachably and rotatably connected with the fastening part 1. This connection can take place at two points of the fastening part 1, at a first point with the help of an undercut 4' and a guide part 3', in connection with a recess or opening 5' in an upper area of the fastening part 1 which is located close to the loop 2 for the belt, and at a second point in the lower area of the fastening part 1. Within that context, in a holster plate 7 that runs parallel to the carrier plate 8, a recess 5 is provided which corresponds to the recess 5' of the carrier plate 8. Furthermore, U-shaped areas that run parallel to the plane of the holster plate 7 are formulated in a single piece with it that form an undercut 4 and a guide part 3, analogously to the corresponding parts 3' and 4' in the upper area of the belt part. These components correspondingly form a connection device 21 and 21', respectively, on the fastening part 1.

The connection functions in such a way that a connection part 6 that protrudes from the weapon part 10 in a button-like manner is pushed into the area of the undercut 4' and the guide 3' from above until a snap fastener 11 (FIG. 4) reaches the opening 5', and thus the rotatable connection between the two holster parts is guaranteed. Additional cam parts make it possible in certain angular positions of the two parts to achieve a fastening with each other in order to prevent a dangling of the weapon part around the fastening part. These elements form a connection counter device 23 on the weapon part 10 that can optionally be connected with one of the two connection devices 21, 21' on the fastening part 1. This connection counter device 23, which completely corresponds geometrically and functionally to the connection counter device 25 on the adapter 12, is visible in the right illustration of FIG. 3 with its snap fastener.

The installation of the weapon part 10 with its connection counter device 23 in the connection device 21 takes place completely analogously to the installation in the connection device 21'. FIG. 2 depicts the installation of the weapon part 10 in the connection device 21, and FIG. 6 the installation in the connection device 21'. Thus the area is well balanced, for example, between winter and summer clothing, but as has been mentioned further above, an extension of the holster plate 7 from the belt into the area of the thigh does not come into question.

An adapter 12 is then inventively used, for example in the form of a spacer plate which has a principally oblong shape with two ends and has a connection counter device 24 together with a snap fastener 11 in the area of its ends which geometrically and functionally completely corresponds to the connection counter device 23 of the weapon part 10. In the area of the other end, the adapter 12 has a connection device 22 with an opening 15 which geometrically corresponds to the openings 5, 5', and with the assigned guides that correspond to the guides 9, 9'. This connection device 22 consequently corresponds geometrically and functionally with the connection device 21, 21' of the fastening part 1.

Because of this, it becomes possible to use the connection counter device 24 in the fastening part 1 or, more precisely, in its connection device 21, and to use the weapon part 10 with its connection counter device in the connection device 22 of the adapter 12. It is consequently separated from the weapon part 10 by the distance between the connection device 22 and the connection counter device 24 further downward away from the belt or the loop 2 in the area of the wearer's thigh. In the illustrated embodiment, the spacer plate has a holding part 13 which is provided with slots 14 that make it possible to pull a leg loop 17 through (FIG. 7) and thus to attach the lower part of the adapter 12 to the leg, thus avoiding a dangling or slapping of the holster or the weapon. In order to make the fastening easier, a closure 18 is preferably provided on the leg loop through the opening of which the spacer plate is released with respect to the leg.

FIG. 7 depicts the fastening of the connection counter device 24 and, along with it, of the adapter 12 to the upper connection device 21' of the fastening part 1; it goes without saying that it is also possible to fasten the adapter 12 in the lower connection device 21. From FIG. 7, it is also especially clear that in the depicted embodiment, the weapon part 10 has a safety device 20 by means of which a weapon (not depicted) in the weapon part 10 is mechanically attached in such a way that only after the operation of a corresponding lever of the safety device 20 is the weapon released and can be drawn. In this way, it can in particular be prevented that in a scuffle, an unauthorized person draws the weapon and uses it against the wearer. For this reason, the safety device is also located in the area between the wearer and the weapon, such that for the wearer, it is easily reachable with his or her thumb, but for other people, it is hardly accessible.

The invention is not restricted to the depicted embodiment, but rather it can be repeatedly modified. For example, instead of the fastening part 1, a pad can be used that can be pushed into a slot or a fold of a tightly fitting piece of clothing. It goes without saying that the fastening part, whether a pad or a belt part, can be equipped with one or two connection devices, and of course the detachable connection between the fastening part and the weapon part does not have to have the depicted arrangement. Thus the capacity for turning may be omitted or even the rotatable attachment may be omitted, the opening can have a different form, and the guide naturally can, too. What is essential is only that the adapter is equipped at its end that faces the fastening part with the elements of the connection which are normally provided on the weapon part, and that the adapter has, in the area that is assigned to the weapon part, the elements of the connection which normally carries the fastening part. In this way, it is possible without any change in previously known holster parts to provide an inventive adapter and to arrive at the desired carrying method of the weapon in the area of the thigh.

If as in this present case, arrangements of the connection between the fastening part and the weapon part are known which optionally allow or do not allow twisting and, in the case of twistability, optionally make possible an attaching or not, then elements of that sort can be provided on the adapter, just as long as they remain compatible with the corresponding system of the connection elements.

With regard to materials to be used, all materials are possible that are normally used for the fastening parts or the weapon parts; these can in particular be plastics. If spacer sheets for holsters are planned out of other materials, such as leather, then it is of course possible to also produce these out of metal in order to keep as small as possible an increase in the distance between the carrier and the weapon as a consequence of the thickness of the spacer sheet. In that sense, it is also possible to execute the adapter not evenly but rather bent (when viewed in cross section) such that its connection device 22 lies in the same plane as the connection devices 21, 21', depending upon whether the fastening part has one or two connection devices.

The invention claimed is:

1. A holster for securing a weapon comprising:

a weapon part that holds the weapon;

a fastening part that is worn by or attached to the user, the fastening part comprising at least one connection device that includes a U-shaped guide that incorporates an undercut along an inner surface of the guide;

the weapon part comprising at least one connection counter device that includes a complementary disk that is configured to be urged into the U-shaped guide until it engages the undercut of the connection device and becomes detachably connected to the connection device of the fastening part thereby; and a spacer plate comprising a second connection counter device adjacent the upper end of the spacer plate that also includes a complementary disk configured to be urged into the U-shaped guide of the at least one connection device until it engages the undercut of the connection device and becomes detachably connected to the connection device of the fastening part, and a second connection device adjacent the lower end of the spacer plate that also includes a U-shaped guide that incorporates an undercut along an inner surface of the guide so that it can receive the at least one connection counter device of the weapon part such that the spacer plate can be reversibly interposed between the fastening part and the weapon part so as to position the weapon part lower on the user's body while maintaining the weapon part at approximately the same lateral distance from the user's body.

2. The holster of claim 1, wherein each connection device comprises a recess configured to receive a portion of either connection counter device.

3. The holster of claim 2, wherein each connection counter device comprises a snap fastener that engages the recess.

4. The holster of claim 1, wherein the fastening part comprises one or more loops configured to be attached to the user's belt.

5. The holster of claim 1, wherein the spacer plate further comprises slots configured to receive a strap for securing the spacer plate to the user's thigh.

6. The holster of claim 1, wherein each connection device is compatible with and can receive and detachably connect to either connection counter device.

7. The holster of claim 1, wherein each connection device is configured to detachably and rotatably connect to the connection counter device of the weapon part.

* * * * *